United States Patent [19]

Wolff

[11] 4,429,420

[45] Feb. 7, 1984

[54] COWBOY HAT

[75] Inventor: Natalie A. Wolff, Arlington, Tex.

[73] Assignee: Container Corporation of America, Chicago, Ill.

[21] Appl. No.: 390,310

[22] Filed: Jun. 21, 1982

[51] Int. Cl.[3] ..... A42B 1/00

[52] U.S. Cl. ..... 2/175; 2/200; 2/177; 2/192

[58] Field of Search ..... 2/200, 175, 177, 192

[56] References Cited

U.S. PATENT DOCUMENTS

| | | | |
|---|---|---|---|
| 2,105,002 | 1/1938 | Miller | 2/175 |
| 2,410,158 | 10/1946 | Gardner | 2/192 |
| 4,246,659 | 1/1981 | Lyons | 2/200 |

*Primary Examiner*—Werner H. Schroeder
*Assistant Examiner*—Mary A. Ellis
*Attorney, Agent, or Firm*—Richard W. Carpenter; Davis Chin

[57] ABSTRACT

A cowboy hat is formed from a single sheet of paperboard which is cut and scored. The cowboy hat includes a flat top portion having side edges, a generally rectangular-shaped crown section, a generally crescent-shaped crown section, a C-shaped brim section, an arcuate-shaped brim section, a first brim extension and a second brim extension. A first elliptical-shaped crown connecting portion is foldably joined between one side edge of the top portion and the rectangular-shaped crown section. A second elliptical-shaped crown connecting portion is foldably joined between the other side edge of the top portion and the crescent-shaped crown section. Interconnecting panels are foldably joined to ends of the crescent-shaped crown section.

5 Claims, 4 Drawing Figures

COWBOY HAT

BACKGROUND OF THE INVENTION

1. Field of the Invention:

This invention relates generally to hats formed of paperboard and more particularly, it relates to a hat formed from a unitary blank of paperboard which has been cut and scored so that when assembled it assumes the style of a cowboy hat.

2. Description of the Prior Art:

The prior art appears to be best exemplified in the following U.S. Pat. Nos. which were developed in a search directed to the subject matter of this application: U.S. Pat. No. 1,201,277; U.S. Pat. No. 1,926,430; U.S. Pat. No. 2,105,002; U.S. Pat. No. 2,410,158; U.S. Pat. No. 2,594,906; U.S. Pat. No. 2,988,743; U.S. Pat. No. 3,266,056; U.S. Pat. No. 4,246,659.

None of the prior art uncovered in the search disclosed a cowboy hat of a construction like that of the present invention which is formed from a single sheet of paperboard.

SUMMARY OF THE INVENTION

Accordingly, it is a general object of the present invention to provide a cowboy hat formed of a new and improved construction.

It is another object of the present invention to provide a cowboy hat which is formed from a single sheet of paperboard that can be shipped and stored in the knocked-down condition but can be easily assembled by the consumer.

It is another object of the present invention to provide a cowboy hat which is relatively inexpensive to manufacture and is yet simple to assemble for use.

In accordance with the aims and objectives of the present invention, there is provided a cowboy hat which is formed from a single sheet of paperboard that is cut and scored. The cowboy hat includes a flat top portion having side edges, a generally rectangular-shaped crown section, a generally crescent-shaped crown section, a C-shaped brim section, an arcuate-shaped brim section, a first brim extension and a second brim extension. A first elliptical-shaped crown connecting portion is foldably joined between one side edge of the top portion and the rectangular-shaped crown section. A second elliptical-shaped crown connecting portion is foldably joined between the other side edge of the top portion and the crescent-shaped crown section. Interconnecting panels are foldably joined to ends of the crescent-shaped crown section. The C-shaped brim section includes a central portion, an upper crescent-shaped portion and a lower crescent-shaped portion, the central portion thereof being foldably joined to the rectangular-shaped crown section. First interlocking members are formed on the upper and lower portions of the C-shaped brim portion and the arcuate-shaped brim portion. Second inter-locking members are formed on the rectangular-shaped crown section and the interconnecting panels. Further, inner edges of the upper and lower portions of the C-shaped brim section are formed with a plurality of tabs which are adapted to flex outwardly for fitting heads of different sizes.

BRIEF DESCRIPTION OF THE DRAWINGS

These and other objects and advantages of the present invention will become more fully apparent from the following detailed description when read in conjunction with the accompanying drawings, wherein.

DESCRIPTION OF THE PREFERRED EMBODIMENT

Figure 3:
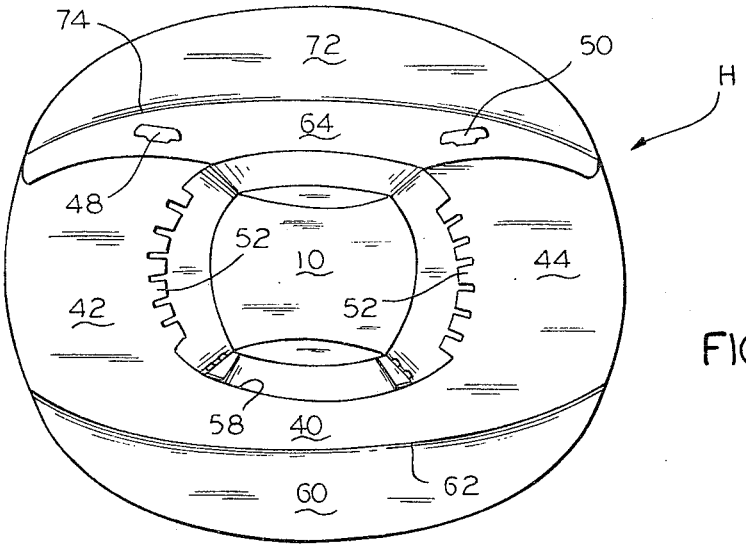
FIG. 3 is a bottom plan view of the cowboy hat in its fully assembled condition in accordance with the present invention.
Figure 1:
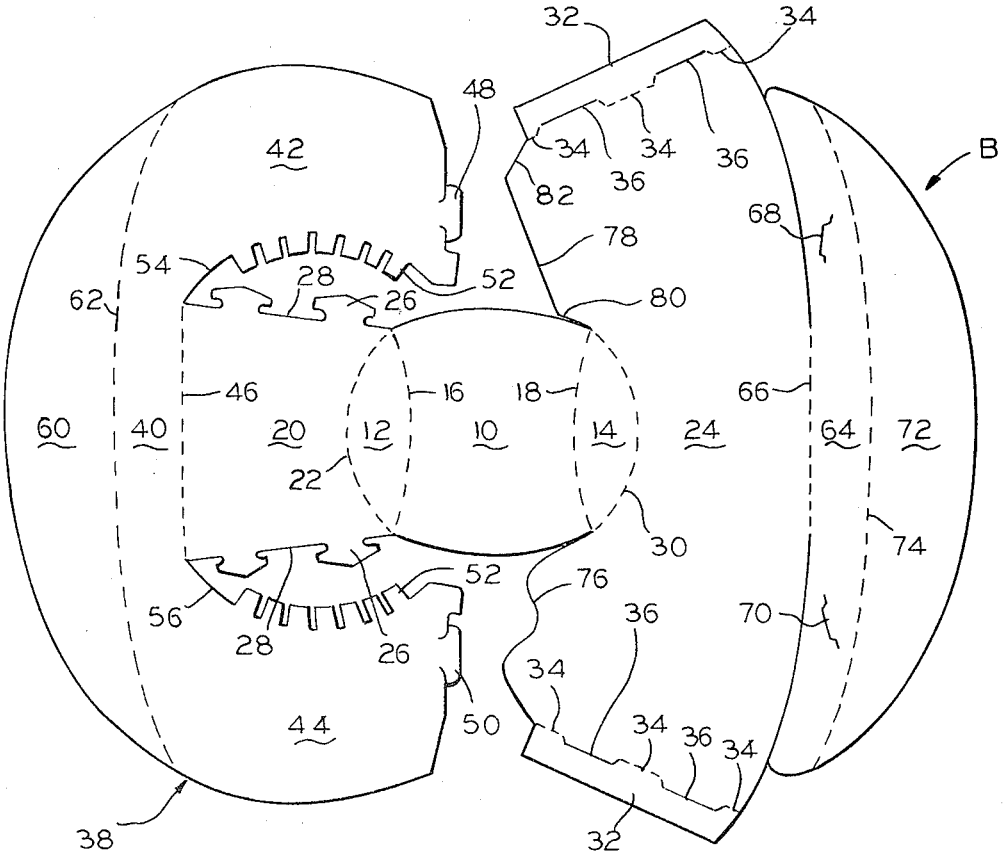
FIG. 1 is a bottom plan view illustrating a blank for forming a cowboy hat in accordance with the present invention.
Figure 4:
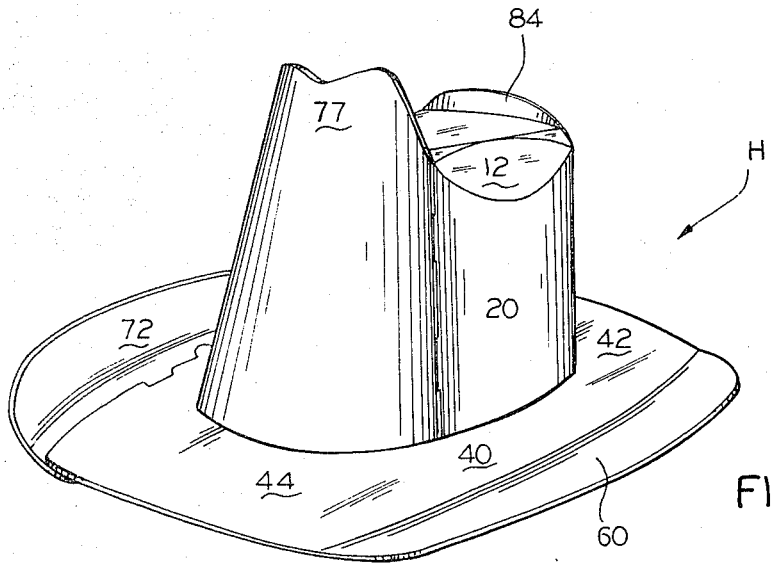
FIG. 4 is a prospective view illustrating the cowboy hat formed from the blank of FIG. 1.
Figure 2:
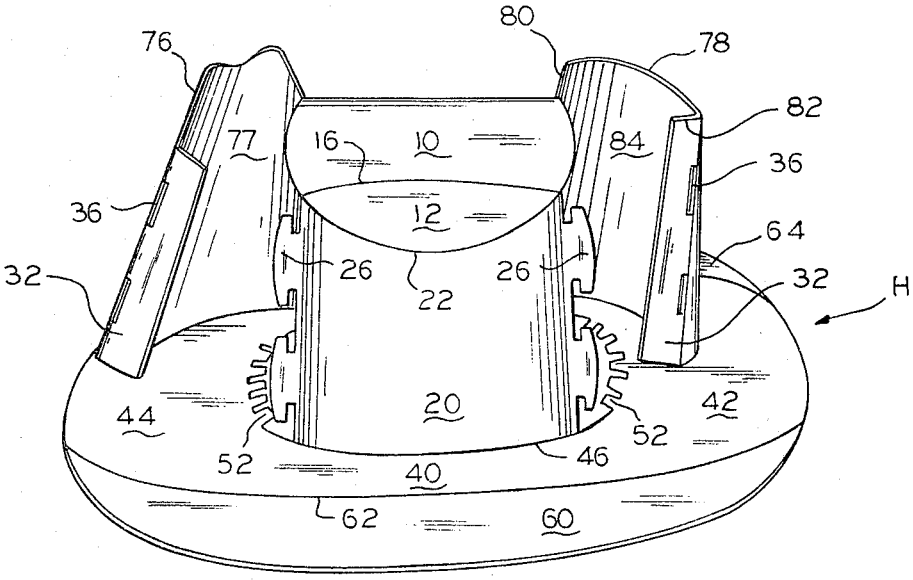
FIG. 2 is a view of the blank shown in FIG. 1 in its partially assembled condition to provide a cowboy hat.

Referring now in detail to the various views of the drawings, there is shown in FIG. 1 a blank B of a single sheet of suitable structural material such as paperboard and the like used to form a cowboy-style hat H of FIGS. 2 through 4. Both sides of the blank are adapted for printing of advertising material, assembly instruction and other similar markings. The blank includes a flat top portion 10 and two crown connecting portions 12, 14. The crown connecting portion 12 is substantially elliptical in shape and is joined to one side edge of the top portion 10 on curvilinear score line 16. Similarly, the crown connecting portion 14 is substantially elliptical in shape and is joined to the other side edge of the top portion 10 on curvilinear score line 18. A first crown section 20 of a generally rectangular shaped is connected on curvilinear score line 22 to the crown connecting portion 12. The crown section 20 is formed with a plurality of projections or locking tabs 26 along edges 28. A second crown section 24 is crescent-shaped in configuration and has connected on its ends thereof interconnecting panels 32 along interrupted score lines 34. Each of the interconnecting panels 32 are provided with a plurality of slits or slots 36. The locking tabs 26 are arranged in alignment with the corresponding slots 36 for interlocking insertion therein and for cooperative engagement to form the crown of the hat.

A generally C-shaped brim section 38 includes a central portion 40, an upper crescent-shaped portion 42 and a lower crescent-shaped portion 44. The central portion 40 of the brim section 38 is joined to the first crown section 20 along score line 46. The upper portion 42 is provided with a locking tab 48, and the lower portion 44 is provided with a locking tab 50. A plurality of rectangularly-shaped tabs 52 are formed adjacent inner edges 54, 56 of the respective upper and lower portions 42, 44 and are adapted for seating comfortably around the head of the wearer. The tabs 52 are capable of being deformed or flexed outwardly so as to adjust the size of opening 58 to fit the head of the wearer. A first brim extension 60 has an arcuate shape and is connected to the C-shaped brim section 38 along curvilinear score line 62.

A second brim section 64 has an arcuate shape and is connected to the second crown section 24 along score line 66. The brim section 64 is provided with slits 68, 70 which are adapted to receive the tabs 48, 50 on the respective upper and lower sections 42, 44 of the brim section 38 to form the brim of the hat. A second brim extension 72 is formed of an arcuate shape similar to that of the brim extension 60 and is connected to the second brim section 64 along curvilinear score line 74.

In order to assemble the cowboy hats on the blank B, the blank is folded and turned over to the partially completed condition illustrated in FIG. 2. In this condition, the tabs 48, 50 on the upper and lower portions 42, 44 of the C-shaped brim section 48 are inserted into the slits 68, 70 on the second brim section 64 to form the brim of the hat, as can best be seen from FIG. 3. Then, the interconnecting panels 32 with their adjacent portions of the second crown section 24 are rotated so that the locking tabs 26 on the first crown section 20 can be inserted into the slits 36 on the interconnecting panels to form the crown of the hat, which can be seen in FIGS. 2 and 3. Next, folds are made along the fold lines 16, 18 and the fold lines 62, 74 to provide the completed hat configuration shown in FIG. 4. It should be noted that the second crown section 24 has a sinusoidal contour line 76 to define a front crown portion 77. Further, the second crown section 24 has a contour formed from a straight line 78 and two sloping lines 80, 82 to define a back crown portion 84.

From the foregoing detailed description, it can be thus seen that the present invention provides a new and improved cowboy hat which is formed from a single sheet of paperboard and which can be easily assembled for use by the consumer. Further, due to the tabs formed on the inner edges of the upper and lower portions of the C-shaped brim section, the hat is easily adjustable for fitting heads of different sizes.

While there has been illustrated and described what is at present to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention, but that the invention will include all embodiments falling within the scope of the appended claims.

What is claimed is:

1. A cowboy hat formed from a single sheet of paperboard which is cut and scored, said hat comprising:

a flat top portion having side edges;

a generally rectangular-shaped crown section;

a first elliptical-shaped crown connecting portion foldably joined between one side edge of said top portion and said rectangular-shaped crown section;

a generally crescent-shaped crown section;

a second elliptical-shaped crown portion foldably joined between the other side edge of said top portion and said crescent-shaped crown section;

interconnecting panels foldably joined to ends of said crescent-shaped crown section;

a C-shaped brim section including a central portion, an upper crescent-shaped portion and a lower crescent-shaped portion;

said central portion of the C-shaped brim section being foldably joined to said rectangular-shaped crown section;

an arcuate-shaped brim section foldably joined to said crescent-shaped crown section;

first interlocking means formed on said upper and lower portion of said C-shaped brim section and said arcuate-shaped brim section;

second interlocking means formed on said rectangular-shaped crown section and said interlocking panels;

a first brim extension of an arcuate shape being foldably joined to said C-shaped brim section; and a second brim extension of an arcuate shape being foldably joined to said arcuate-shaped brim section.

2. A cowboy hat as claimed in claim 1, wherein inner edges of said upper and lower portions of said C-shaped brim section are formed with a plurality of tabs which are adapted to flex outwardly for fitting heads of different sizes.

3. A cowboy hat as claimed in claim 1, wherein said first interlocking means comprises locking tabs and slits adapted for cooperative engagement to form the brim of the hat.

4. A cowboy hat as claimed in claim 1, wherein said second interlocking means comprises a plurality of tabs and slits adapted for cooperative engagement to form the crown of the hat.

5. A unitary blank of paperboard which is cut and scored for forming a hat, said blank comprising:

a flat top portion having side edges;

a generally rectangular-shaped crown section;

a first elliptical-shaped crown connecting portion foldably joined to one side edge of said top portion and said rectangular-shaped crown section along curvilinear score lines;

a generally crescent-shaped crown section;

a second elliptical-shaped crown portion foldably joined to the other side edge of said top portion and said crescent-shaped crown section along curvilinear score lines;

interconnecting panels foldably joined on score lines to ends of said crescent-shaped crown section;

a C-shaped brim section including a central portion, an upper crescent-shaped portion and a lower crescent-shaped portion;

said central portion of the C-shaped brim section being foldably joined along a score line to said rectangular-shaped crown section;

an arcuate-shaped brim section foldably joined along a curvilinear score line to said crescent-shaped crown section;

said upper and lower portion of said C-shaped brim section having a locking tab formed thereon and said arcuate-shaped brim section having slits formed thereon;

said rectangular-shaped crown section having a plurality of tabs formed thereon and said interlocking panels having a plurality of slits formed thereon;

a first brim extension of an arcuate shape being foldably joined along a curvilinear score line to said C-shaped brim section; and a second brim extension of an arcuate shape being foldably along a curvilinear score line to said arcuate-shaped brim section.

* * * * *